US011101543B2

(12) United States Patent
Shinkawa

(10) Patent No.: US 11,101,543 B2
(45) Date of Patent: Aug. 24, 2021

(54) WIRELESS COMMUNICATION DEVICE

(71) Applicant: Yamaha Corporation, Hamamatsu (JP)

(72) Inventor: Tomohiro Shinkawa, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 16/704,167

(22) Filed: Dec. 5, 2019

(65) Prior Publication Data

US 2020/0112083 A1 Apr. 9, 2020

Related U.S. Application Data

(63) Continuation of application No. PCT/JP2017/022351, filed on Jun. 16, 2017.

(51) Int. Cl.

| | |
|---|---|
| ***H04B 1/03*** | (2006.01) |
| ***H04B 1/08*** | (2006.01) |
| ***H01Q 1/42*** | (2006.01) |
| ***H01Q 1/24*** | (2006.01) |
| ***H01Q 1/22*** | (2006.01) |
| ***H01Q 19/22*** | (2006.01) |

(52) U.S. Cl.

CPC ..... *H01Q 1/24* (2013.01); *H01Q 1/2291* (2013.01); *H01Q 19/22* (2013.01)

(58) Field of Classification Search

CPC .. H04B 1/03; H04B 1/08; H04B 1/40; H04M 1/02; H04M 1/03; H01Q 1/24; H01Q 1/2291; H01Q 19/22; H01Q 1/42; H01Q 1/38; H01Q 3/01

See application file for complete search history.

(56) References Cited

U.S. PATENT DOCUMENTS

2001/0028247 A1* 10/2001 King ..... G01V 3/32 324/312
2002/0047803 A1* 4/2002 Ishitobi ..... H01Q 9/0457 343/700 MS
2004/0166734 A1* 8/2004 Festag ..... G02B 6/4277 439/607.28
2005/0024276 A1 2/2005 Izumi (Continued)

FOREIGN PATENT DOCUMENTS

CN 1577973 A 2/2005
CN 104064854 A 9/2014

(Continued)

OTHER PUBLICATIONS

English translation of document C2 (Japanese-language Written Opinion (PCT/ISA/237) previously filed on Dec. 5, 2019) issued in PCT Application No. PCT/JP2017/022351 dated Sep. 5, 2017 (five (5) pages).

(Continued)

*Primary Examiner* — Andrew Wendell

(74) *Attorney, Agent, or Firm* — Crowell & Moring LLP

(57) ABSTRACT

A wireless communication device includes a housing, an antenna, a metal plate, a sensor and a controller. The antenna placed within the housing. The metal plate is detachably placed in the housing. The metal plate is higher in electric conductivity than the housing and has a surface facing the (Continued)

antenna when the metal plate is placed in the housing. The sensor is configured to sense placement of the metal plate. The controller is configured to receive a result of sensing detected by the sensor.

20 Claims, 10 Drawing Sheets

(56) References Cited

U.S. PATENT DOCUMENTS

2009/0323269 A1* 12/2009 Iwata ..... G06F 1/162 361/679.09
2013/0012127 A1* 1/2013 Orihara ..... H01Q 1/42 455/41.1
2013/0029625 A1* 1/2013 Park ..... H03K 17/955 455/272
2014/0132458 A1* 5/2014 Teng ..... H01Q 1/243 343/702
2014/0285385 A1 9/2014 Aoki et al.
2016/0142083 A1* 5/2016 Kim ..... H01Q 9/145 455/300
2016/0276737 A1* 9/2016 Nakamura ..... H01Q 1/50
2017/0201004 A1* 7/2017 Rokhsaz ..... G06K 7/10148
2018/0227775 A1* 8/2018 Bisiules ..... H01Q 1/246

FOREIGN PATENT DOCUMENTS

JP 2005-26943 A 1/2005
JP 2011-61622 A 3/2011
JP 5050021 B2 10/2012

OTHER PUBLICATIONS

International Search Report (PCT/ISA/210) issued in PCT Application No. PCT/JP2017/022351 dated Sep. 5, 2017 with English translation (four (4) pages).
Japanese-language Written Opinion (PCT/ISA/237) issued in PCT Application No. PCT/JP20171022351 dated Sep. 5, 2017 (five (5) pages).
English translation of Chinese Office Action issued in Chinese Application No. 201780091961.X dated Sep. 23, 2020 (11 pages).
English translation of Chinese Office Action issued in Chinese Application No. 201780091961.X dated Apr. 27, 2021 (nine (9) pages).

* cited by examiner

WIRELESS COMMUNICATION DEVICE

CROSS REFERENCE TO RELATED APPLICATIONS

This application is based upon and claims the benefit of priority from the prior PCT Application No. PCT/JP2017/022351 filed on Jun. 16, 2017, the entire contents of which are incorporated herein by reference.

FIELD

The present invention relates to a wireless communication device.

BACKGROUND

Conventionally, as a wireless communication device for use in a wireless LAN, there has been a device obtained by integrating a wireless communication device having a directional antenna and a wireless communication device having an omnidirectional antenna with each other. As a technology to achieve such a device, there has been a technology to configure a director of a predetermined length, a reflector, and a radiator so that their mutual positional relationship is changeable. Specifically, there has been proposed an antenna device including a structure that is switchable between a first arrangement in which a director, a reflector, and a radiator are parallel and concentrically placed at predetermined spacings to function as a directional antenna and a second arrangement in which at least one of the director, the reflector, and the radiator is rearranged so that the antenna device functions as an omnidirectional antenna.

Such an antenna device is capable of changing the mutual relationship between the director, the reflector, and the radiator and can change between the first arrangement in which the antenna device functions as a directional antenna and the second arrangement in which the antenna device function as an omnidirectional antenna. This makes it possible to use one antenna device as both a directional antenna and an omnidirectional antenna.

SUMMARY

According to an embodiment of the present invention, there is provided a wireless communication device including: a housing; an antenna placed within the housing; a metal plate, detachably placed in the housing, being higher in electric conductivity than the housing and having a surface facing the antenna when the metal plate is placed in the housing; a sensing unit configured to sense placement of the metal plate; and an output unit configured to output a result of sensing detected by the sensing unit.

According to an embodiment of the present invention, there is provided a wireless communication device including: a housing; an antenna placed within the housing; a metal plate, detachably placed in the housing, having a surface facing the antenna when the metal plate is placed in the housing and making directivity higher in a direction opposite to the antenna when placed than when not placed; a sensing unit configured to sense placement of the metal plate; and an output unit configured to output a result of sensing detected by the sensing unit.

The embodiments of the present invention make it possible to provide a wireless communication device that allows a general user to easily change directivity.

DESCRIPTION OF EMBODIMENTS

Figure 1:
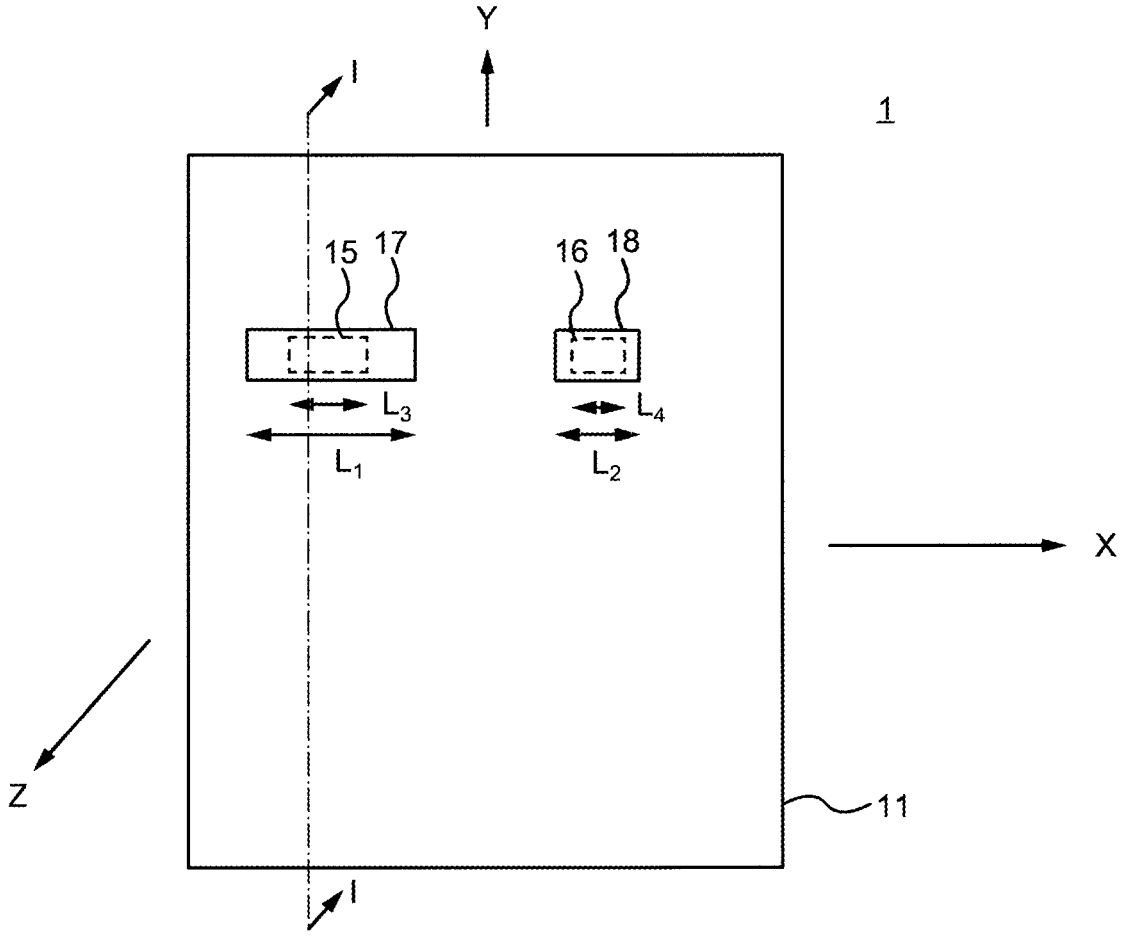
FIG. 1 is an explanatory diagram (plan view) schematically showing a configuration of a wireless communication device.

The existing technology makes it possible to achieve an indefinitely large number of radiating patterns by changing the position of the radiator. However, a general user has no way of knowing where the right position is, so there may be undesirably deterioration in gain, depending on the mutual relationship between the director, the reflector, and the radiator.

In order to solve the problems entailed by the conventional technology, the embodiments of the present invention are designed to provide a wireless communication device that allows a general user to easily change directivity.

Embodiments of the present invention are described in detail below with reference to the drawings. The embodiments to be hereinafter prescribed are examples of embodiments of the present invention, and the present invention is not limited to these embodiments. It should be noted that in the drawings that are referred to in the present embodiment, identical parts or parts having the same functions are given identical signs or similar signs (signs each formed simply by adding A, B, or the like to the end of a number) and a repeated description thereof may be omitted. Further, the dimensional ratios of the drawings (such as the ratios between components and the ratios of length, width, and height directions) may be different from actual ratios for convenience of explanation, and some of the components may be omitted from the drawings.

Figure 2:
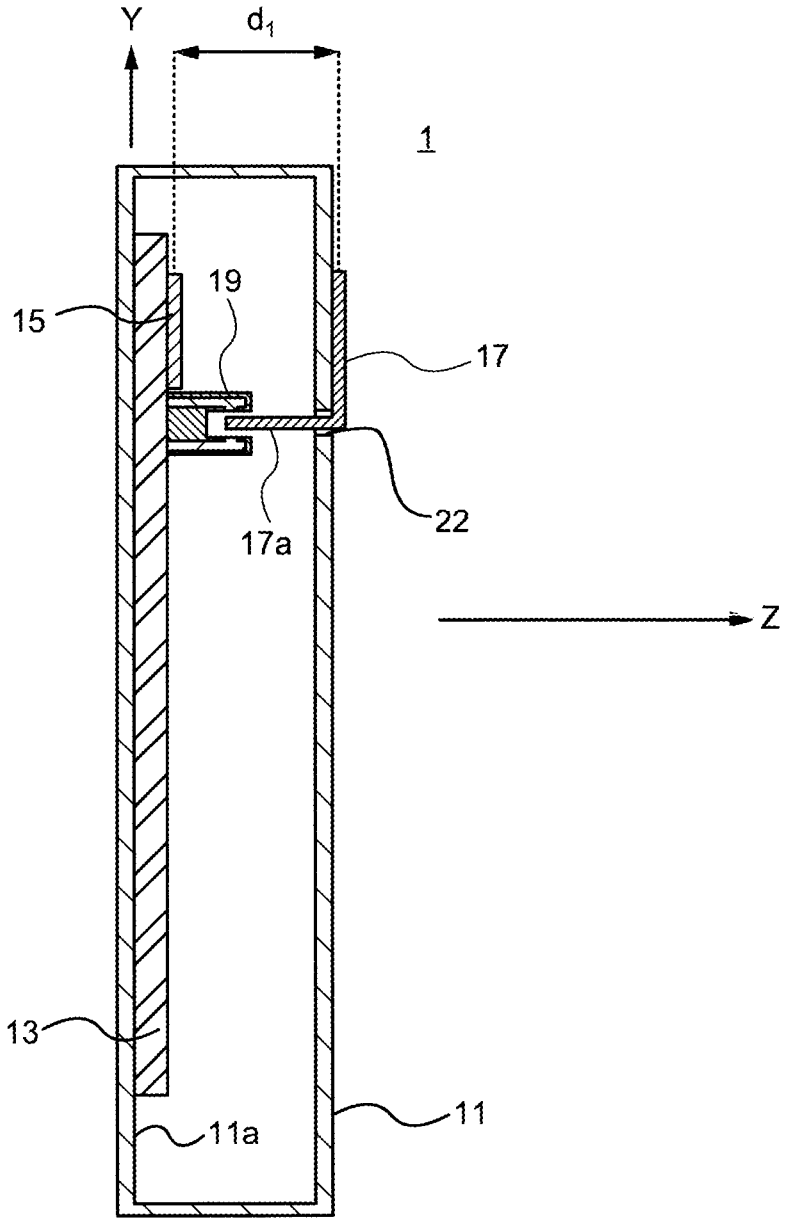
FIG. 2 is a cross-sectional view of the wireless communication device as taken along line I-I in FIG. 1.

A wireless communication device 1 according to an embodiment of the present invention is described with reference to FIGS. 1 and 2. FIG. 1 is an explanatory diagram (plan view) schematically showing a configuration of the wireless communication device 1 according to an embodiment of the present invention. FIG. 2 is a cross-sectional view of the wireless communication device 1 as taken along line I-I in FIG. 1. The wireless communication device 1 includes a housing 11, a substrate 13, a first antenna 15, a second antenna 16 (see FIG. 4), a first metal plate 17, a second metal plate 18, a first sensing unit 19, a second sensing unit 20 (see FIG. 4), and an opening 22. In this example, the wireless communication device 1 is a wireless access point. However, without being limited to this, the wireless communication device 1 may alternatively be a wireless LAN router or the like.

In this example, the housing 11 has a cuboidal shape. However, the housing 11 may have any shape as long as the first antenna 15 and the first metal plate 17 can be placed at a predetermined distance $d_1$ from each other and the second antenna 16 and the second metal plate 18 can be placed at a predetermined distance $d_2$ from each other. In this example, the housing 11 is made of a resin material. However, the material of which the housing 11 is made is not limited to the resin material, provided the material is not a material, such as a metal material, that serves as a reflector or a director.

Further, in this example, the housing 11 has the opening 22. When viewed in the cross-section shown in FIG. 2, the opening 22 is located above the center of the housing 11. However, the opening 22 is not limited to being located above the center of the housing 11, provided that when the first metal plate 17 is placed in the housing 11, the first metal plate 17 is disposed in a position where a surface of the first metal plate 17 and a surface by which the first antenna 15 is constituted face each other.

The substrate 13 is placed inside the housing 11. In this example, the substrate 13 is placed on an inside surface 11*a* of the housing 11. However, a portion of the substrate 13 may be out of contact with the inside surface 11*a*. Further, in this example, the substrate 13 is a single-layer substrate. Alternatively, the substrate 13 may be a multi-layer substrate. In a case where the substrate 13 is a multi-layer substrate, the first antenna 15 and the second antenna 16 can be placed in position on an inner layer as will be described later.

The first antenna 15 is disposed within the housing 11. In this example, the first antenna 15 is placed on the substrate 13. Similarly, the second antenna 16 too is disposed within the housing 11. In this example, the second antenna 16 is disposed on the substrate 13. Note, however, that the substrate 13 is optional. That is, the first antenna 15 or the second antenna 16 do not need to be placed on the substrate 13.

Further, in this example, the first antenna 15 and the second antenna 16 are flat panel antennas. Moreover, in this example, the first antenna 15 and the second antenna 16 are formed by being printed on the substrate 13. Without being limited to flat panel antennas printed on the substrate 13, the first antenna 15 and the second antenna 16 may alternatively be flat panel antennas such as planar inverted-F antennas (PIFAs) or patch antennas.

In this example, the first antenna 15 and the second antenna 16 are disposed on a front surface of the substrate 13. Alternatively, the first antenna 15 and the second antenna 16 may be disposed on a back surface of the substrate 13. In a case where the substrate 13 is a multi-layer substrate, the first antenna 15 and the second antenna 16 may be disposed on an inner layer.

The first antenna 15 oscillates, for example, at 2.45 GHz (first frequency). On the other hand, the second antenna 16 oscillates, for example, at 5 GHz (second frequency). In this example, the first antenna 15, which is used for wireless communication in a 2.45 GHz band, and the second antenna 16, which is used for wireless communication in a 5 GHz band, are placed on the substrate 13. Alternatively, only either of the antennas needs to be placed on the substrate 13. Further, in this example, it is assumed that the longitudinal direction of the first antenna 15 and the second antenna 16 is an X-axis in FIG. 1. Note here that the length $L_3$ of the first antenna 15 is a length that extends along the X axis. The length $L_3$ of the first antenna 15 is designed so that the first antenna 15 oscillates at the first frequency. In this example, the length $L_3$ of the first antenna 15 is $\lambda/4$ with respect to the first frequency. Similarly, the length $L_4$ of the second antenna 16 is a length that extends along the X axis. In this example, the length $L_4$ of the second antenna 16 is $\lambda/4$ with respect to the second frequency. It should be noted that the length $L_3$ of the first antenna 15 and the length $L_4$ of the second antenna 16 are not limited to being $\lambda/4$ with respect to the frequencies but may be $\lambda$ when they oscillate at $\lambda$ with respect to the frequencies. In this example, an example has been described in which the first antenna 15 and the second antenna 16 are identical in longitudinal direction to each other. Alternatively, the first antenna 15 and the second antenna 16 may be different in longitudinal direction from each other. In that case, the first antenna 15 and the second antenna 16 have longitudinal directions along separate X axes, respectively. Note, however, that the first antenna 15 and the first metal plate 17 need to have longitudinal directions along an identical axis and the second antenna 16 and the second metal plate 18 too need to have longitudinal directions along an identical axis.

When placed in the housing 11, the first metal plate 17 faces the first antenna 15. Similarly, when placed in the housing 11, the second metal plate 18 faces the second antenna 16. The first metal plate 17 and the second metal plate 18 have a function of guiding, toward the first metal plate 17 and the second metal plate 18, radio waves radiated from the first antenna 15 and the second antenna 16, respectively. In other words, radio waves radiated from the first antenna 15 and the second antenna 16 are strongly radiated toward the first metal plate 17 and the second metal plate 18. In this example, the first metal plate 17 and the second metal plate 18 are directors that directs radio waves radiated from the first antenna 15 and the second antenna 16, respectively. Therefore, when the first metal plate 17 is placed in the housing 11, there is higher directivity in a direction opposite to the first antenna 15 (i.e. a direction from the first antenna 15 toward the first metal plate 17, i.e. a Z-axis direction in FIG. 2) than when the first metal plate 17 is not placed in the housing 11. Similarly, when the second metal plate 18 is placed in the housing 11, there is higher directivity in a direction opposite to the second antenna 16 (i.e. a direction from the second antenna 16 toward the second metal plate 18, i.e. the Z-axis direction in FIG. 2) than when the second metal plate 18 is not placed in the housing 11. Further, the first metal plate 17 and the second metal plate 18 are higher in electric conductivity than the housing 11.

In this example, the longitudinal direction of the first metal plate 17 and the second metal plate 18 too extend along the X axis in FIG. 1. The length $L_1$ of the first metal plate 17 and the length $L_2$ of the second metal plate 18 are lengths that extend along the X axis, as is the case with the length $L_3$ of the first antenna 15 and the length $L_4$ of the second antenna 16, respectively. The length $L_1$ of the first metal plate 17 and the length $L_2$ of the second metal plate 18 are greater than $\lambda/2$ and less than $4\lambda/5$ with respect to the frequencies that the first antenna 15 and the second antenna 16 use, respectively. In this example, as mentioned above, the frequency that the first antenna 15 uses is 2.45 GHz, and the frequency that the second antenna 16 uses is 5 GHz. Accordingly, the length $L_2$ of the second metal plate 18 is shorter than the length $L_1$ of the first metal plate 17. Specifically, the length $L_1$ of the first metal plate 17 is greater than 61.2 mm and less than 98.0 mm. The length $L_2$ of the second metal plate 18 is greater than 30 mm and less than 48 mm.

In this example, the first metal plate 17 has a first protruding portion 17*a* as a portion thereof. That is, the first protruding portion 17*a* and the first metal plate 17 are made of the same material. In a case where the first protruding portion 17*a* and the first metal plate 17 are made of the same material, the first protruding portion 17*a* and the first metal plate 17 can be integrally manufactured. Alternatively, the first protruding portion 17*a* and the first metal plate 17 may be made of different materials. When the first protruding portion 17*a* and the first metal plate 17 are made of different materials, the first protruding portion 17*a* and the first metal plate 17 need to be bonded together. Further, the first protruding portion 17*a* is inserted in the housing 11. Although not illustrated in FIG. 2, the second metal plate 18 too has a second protruding portion 18*a*. A detailed description of the second protruding portion 18*a* is omitted here, as the second protruding portion 18*a* is identical in configuration to the first protruding portion 17*a* of the first metal plate 17.

The first metal plate 17 has a surface that, in a case where the first metal plate 17 has been placed in the housing 11, faces the substrate 13 and the first antenna 15 placed on the substrate 13. Similarly, the second metal plate 18 has a surface that, in a case where the second metal plate 18 has been placed in the housing 11, faces the substrate 13 and the second antenna 16 placed on the substrate 13.

In order to make it hard for the first metal plate 17 and the second metal plate 18 to move from the housing 11 when the first metal plate 17 and the second metal plate 18 have been placed in the housing 11, the housing 11 may have asperities provided on a portion thereof and the first metal plate 17 and the second metal plate 18 may each be shaped to fit the asperities.

The first antenna 15 and the first metal plate 17 are placed at a certain distance $d_1$ from each other. Therefore, the phase of radio waves radiated from the first antenna 15 shifts by a certain amount from the phase of an electric current flowing through the first metal plate 17. Accordingly, when the shift between the phase of an electric current flowing through the first metal plate 17 and the phase of radio waves from the first antenna 15 is reduced or eliminated by adjusting the distance $d_1$ between the first antenna 15 and the first metal plate 17 and the length $L_1$ of the first metal plate 17, they reinforce each other. The distance $d_1$ between the first antenna 15 and the first metal plate 17 is preferably greater than $\lambda/20$ and less than $\lambda/2$ with respect to the radio frequency used. In this example, the radio frequency that the first antenna 15 uses is a 2.45 GHz band. Accordingly, the distance $d_1$ between the first antenna 15 and the first metal plate 17 is preferably greater than 6.1 mm and less than 61.2 mm. More preferably, the distance $d_1$ between the first antenna 15 and the first metal plate 17 is equal to or greater than $\lambda/5$ and less than $\lambda/4$ with respect to the radio frequency used.

Similarly, the second antenna 16 and the second metal plate 18 are placed at a certain distance $d_2$ from each other. The distance $d_2$ between the second antenna 16 and the second metal plate 18 is preferably greater than $\lambda/20$ and less than $\lambda/2$ with respect to the radio frequency used. In this example, the radio frequency that the second antenna 16 uses is 5 GHz. Accordingly, the distance $d_2$ between the second antenna 16 and the second metal plate 18 is preferably greater than 3 mm and less than 30 mm.

Then, when the radio frequency that the first antenna 15 uses is 2.45 GHz and the radio frequency that the second antenna 16 uses is 5 GHz, the preferred specific range (greater than 6.1 mm and less than 61.2 mm) of the distance $d_1$ between the first antenna 15 and the first metal plate 17 and the preferred specific range (greater than 3 mm and less than 30 mm) of the distance $d_2$ between the second antenna 16 and the second metal plate 18 are different from each other. Of course, there is a range of overlap (greater than 6.1 mm and less than 30 mm) between the preferred specific range of the distance $d_1$ and the preferred specific range of the distance $d_2$. Accordingly, for example, in a case where the shape of the housing 11 needs to be arranged into a cuboid, it is only necessary to match the distance $d_1$ and the distance $d_2$ within the range of overlap between the preferred specific range of the distance $d_1$ and the preferred specific range of the distance $d_2$. On the other hand, the distance $d_1$ between the first antenna 15 and the first metal plate 17 and the distance $d_2$ between the second antenna 16 and the second metal plate 18 may be made different from each other so that the first metal plate 17 and the second metal plate 18 can better exhibit their capabilities as directors (i.e. capabilities of increasing directivity).

Figure 3A:
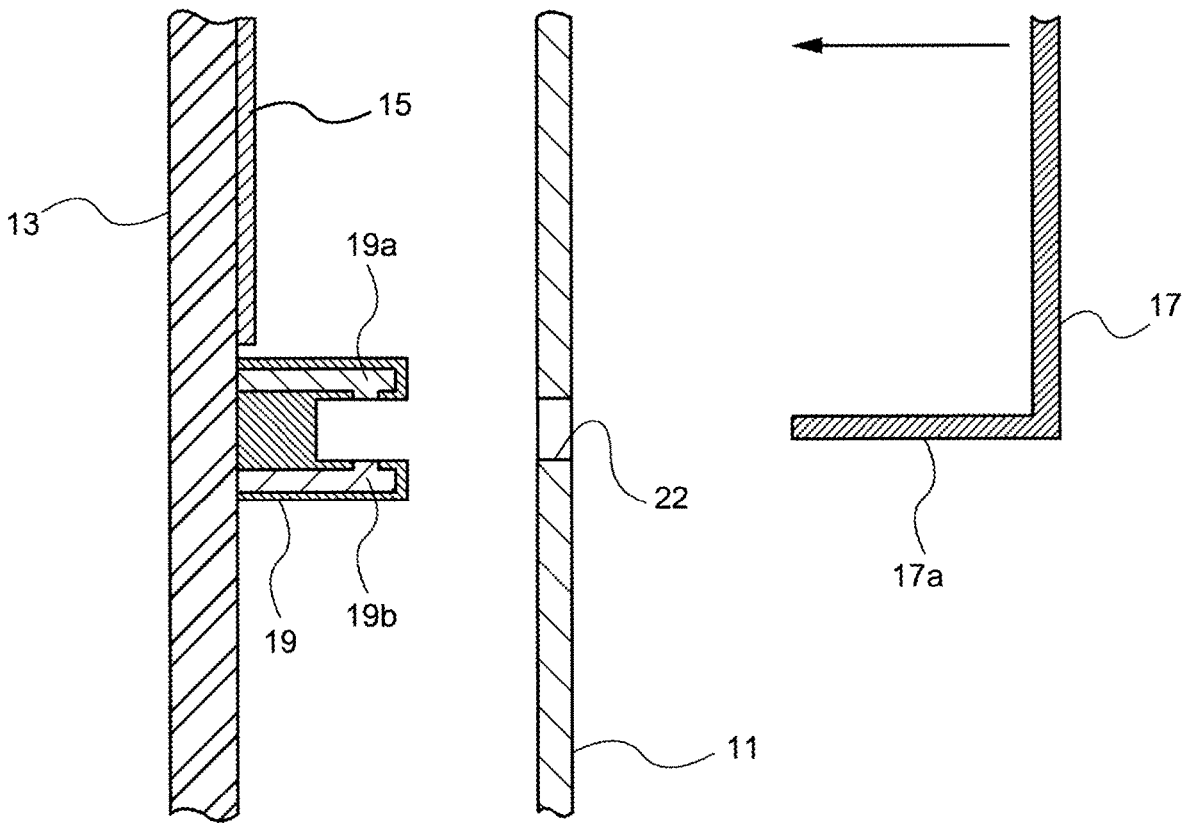
FIG. 3A is an enlarged view (cross-sectional view) of a first sensing unit of the wireless communication device and the area therearound in a case where a first metal plate is not placed in a housing.
Figure 3B:
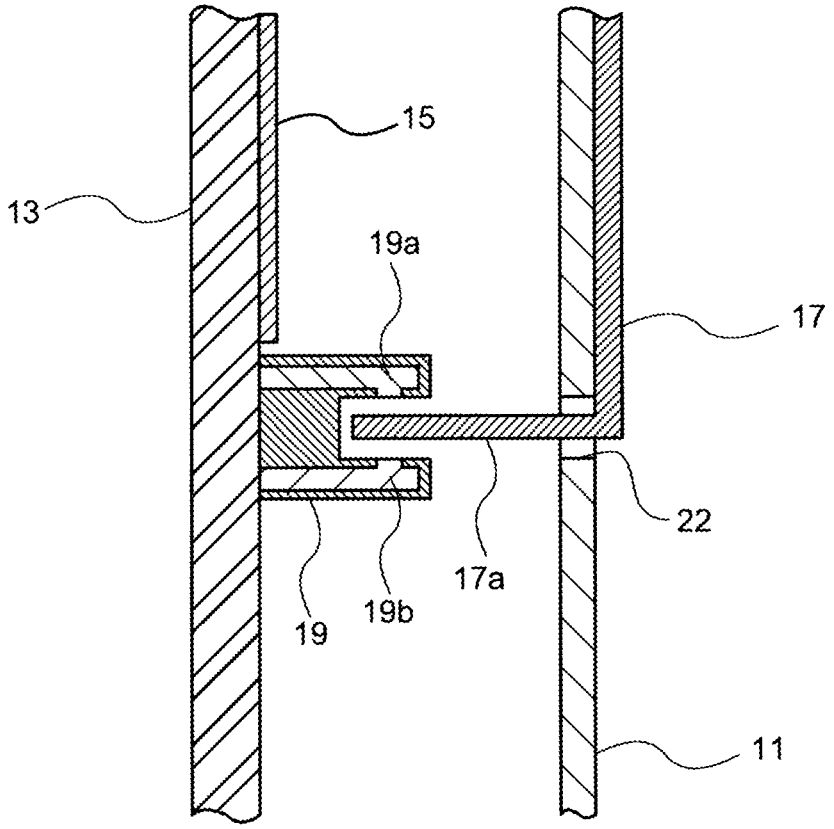
FIG. 3B is an enlarged view (cross-sectional view) of the first sensing unit of the wireless communication device and the area therearound in a case where the first metal plate is placed in the housing.

The first sensing unit 19 senses the placement of the first metal plate 17. FIGS. 3A and 3B are enlarged views (cross-sectional views) of the first sensing unit 19 of the wireless communication device 1 according to an embodiment and the area therearound. In this example, the first sensing unit 19 is a photointerrupter. The photointerrupter has a light-emitting unit 19*a* and a light-receiving unit 19*b* that face each other. Moreover, by the light-receiving unit 19*b* detecting the interruption of light from the light-emitting unit 19*a* by the first protruding portion 17*a*, the placement of the first metal plate 17 in the housing 11 is sensed. This allows the first sensing unit 19 to sense the placement of the first metal plate 17 in the housing 11 without making contact with the first protruding portion 17*a*. The first sensing unit 19 is not limited to the photointerrupter but may be another non-contact sensor. Similarly, the second sensing unit 20 senses the placement of the second metal plate 18. However, a detailed description of the second sensing unit 20 is omitted here, as the second sensing unit 20 is identical in configuration to the first sensing unit 19.

FIG. 3A is an enlarged view (cross-sectional view) of, in the wireless communication device 1 according to an embodiment of the present invention, the first sensing unit 19 of the wireless communication device 1 and the area therearound in a case where the first metal plate 17 is not placed in the housing 11. FIG. 3B is an enlarged view (cross-sectional view) of, in the wireless communication device 1 according to an embodiment of the present invention, the first sensing unit 19 of the wireless communication device 1 and the area therearound in a case where the first metal plate 17 is placed in the housing 11.

As shown in FIG. 3A, the first metal plate 17 is moved in the direction of the arrow in the drawing to be placed in the housing 11. At this point of time, as shown in FIG. 3B, when the light-receiving unit 19*b* detects the interruption of light from the light-emitting unit 19*a* by the first protruding portion 17*a*, the first sensing unit 19 senses the placement of a case including the first metal plate 17 in the housing 11.

Figure 4:
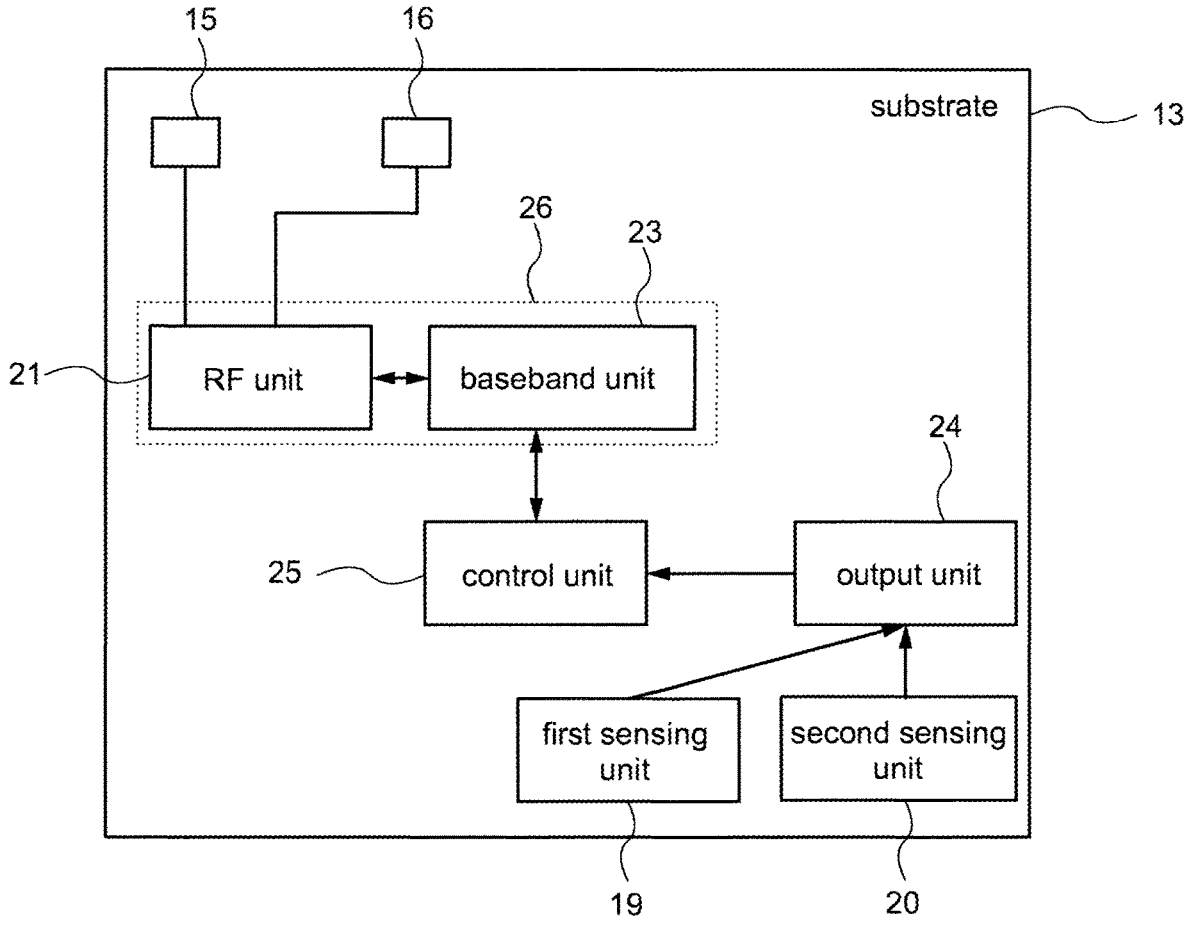
FIG. 4 is a block diagram for explaining a part of the wireless communication device.

FIG. 4 is a block diagram for explaining a part of the wireless communication device 1 according to an embodiment of the present invention. The substrate 13 includes the first antenna 15, the second antenna 16, the first sensing unit 19, the second sensing unit 20, an RF unit 21, a baseband unit 23, an output unit 24, and a control unit 25.

The RF unit 21 processes a signal of a frequency band that is utilized by the wireless communication device 1. In this example, the RF unit 21 processes signals of a 2.45 GHz band and a 5 GHz band. The RF unit 21 is connected to the first antenna 15 and the second antenna 16. Further, the RF unit 21 is connected to the baseband unit 23. In this example, since the frequency bands are at high frequencies such as 2.45 GHz and 5 GHz, signals received by the first antenna 15 and the second antenna 16 are converted from high frequencies into intermediate frequencies (IF) by a receiving mixer of the RF unit 21 and then converted into baseband signals by the baseband unit 23. The RF unit 21 includes well-known components such as various types of mixer for use in transmitting and receiving, and an amplifier such as an LNA, and a filter such as a bandpass filter. However, a description of these components is omitted here. Further, a combination of the RF unit 21 and the baseband unit 23 may be referred to as "communication unit 26". The communication unit 26 transmits and receives information to and from a wireless terminal via the first antenna 15 and/or the second antenna 16.

The control unit 25 controls an operation mode on the basis of a result of sensing outputted by the output unit 24. For example, the control unit 25 exercises various types of control pertaining to wireless LAN communication such as the control of retransmitting in the case of an error having occurred when a signal sent from a transmitting end has been decoded at a receiving end and the control of transmitting timing. Further, when the first sensing unit 19 has sensed the placement of the first metal plate 17 in the housing 11, the control unit 25 may exercise control so as to reduce the transmitting output of the first antenna 15. Similarly, when the second sensing unit 20 has sensed the placement of the second metal plate 18 in the housing 11, the control unit 25 may exercise control so as to reduce the transmitting output of the second antenna 16.

The output unit 24 outputs a result of sensing detected by the first sensing unit 19. Similarly, the output unit 24 outputs a result of sensing detected by the second sensing unit 20. Then, the results thus outputted are used by the control unit 25.

<Simulation>

Figure 5A:
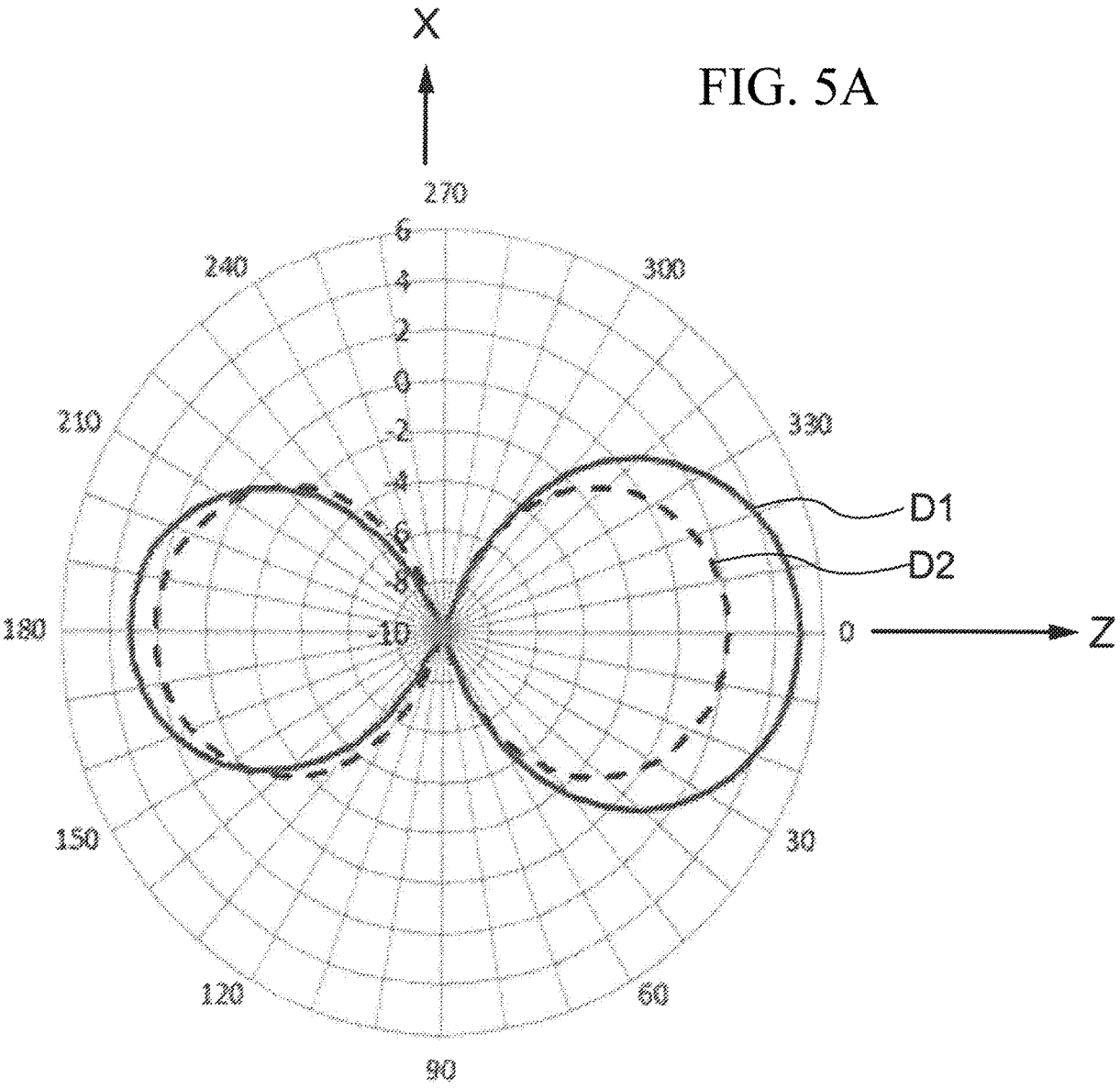
FIG. 5A is a simulation result indicating the directivity of the wireless communication device.
Figure 5B:
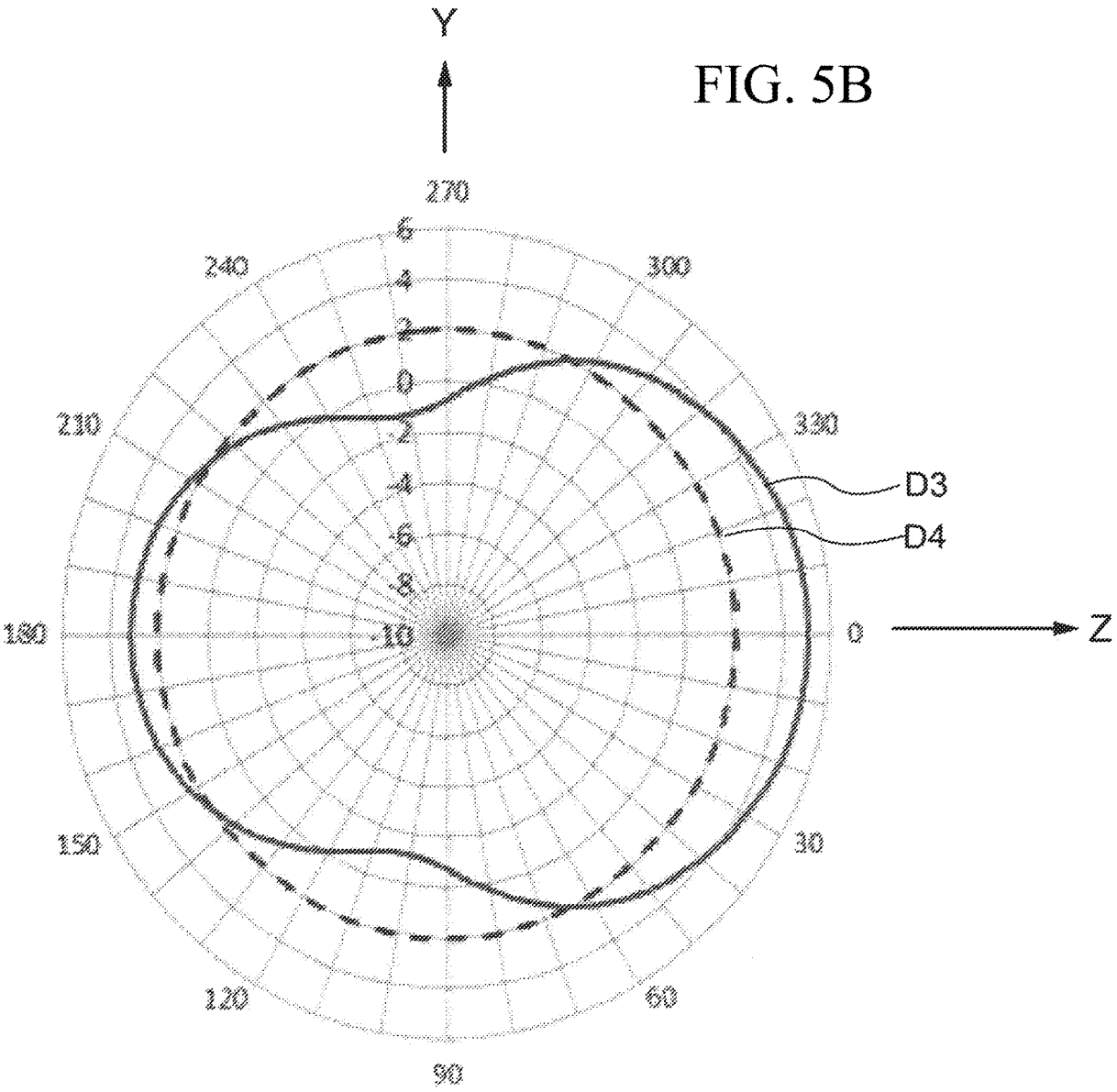
FIG. 5B is a simulation result indicating the directivity of the wireless communication device.

Changes in directivity depending on the presence or absence of the second metal plate 18 in the wireless communication device 1 according to an embodiment of the present invention are described with reference to FIGS. 5A and 5B. FIGS. 5A and 5B are simulation results indicating the directivity of the wireless communication device 1 according to an embodiment of the present invention.

In the present simulation, only the second metal plate 18 in FIG. 1 is used, and the first metal plate 17 is not used. The second antenna 16 is a flat panel antenna for use in a 5 GHz band. Further, the housing 11 is a case made of a resin material. The resin case is designed so that the distance $d_2$ between the second antenna 16 and the second metal plate 18 is $\lambda/4$ (15 mm). Further, the length $L_4$ of the second antenna 16 is $0.35\lambda$ (21 mm).

As shown in FIG. 1, it is assumed that on the same plane as the substrate 13, the crosswise direction, the lengthwise direction, and the direction opposite to the second antenna 16 as seen from the second metal plate 18 (toward this side of the surface of paper in FIG. 1) are the X-axis direction, the Y-axis direction, and the Z-axis direction, respectively. As shown in FIG. 5A, D1 (solid line) indicates antenna gain in a case where the second metal plate 18 is attached to the housing 11. D2 (dotted line) indicates antenna gain in a case where the second metal plate 18 is not attached to the housing 11. In a case where the second metal plate 18 is not attached to the housing 11, the antenna gain in the Z-axis direction is approximately 2 dBi. On the other hand, in a case where the second metal plate 18 is attached to the housing 11, the antenna gain in the Z-axis direction is approximately 5 dBi. Similarly, as shown in FIG. 5B, D3 (solid line) indicates antenna gain in a case where the second metal plate 18 is attached to the housing 11. D4 (dotted line) indicates antenna gain in a case where the second metal plate 18 is not attached to the housing 11. In a case where the second metal plate 18 is not attached to the housing 11, the antenna gain in the Z-axis direction is approximately 2 dBi. On the other hand, in a case where the second metal plate 18 is attached to the housing 11, the antenna gain in the Z-axis direction is approximately 5 dBi. Then, the attachment of the second metal plate 18 to the housing 11 makes the antenna gain in the Z-axis direction greater by approximately 3 dBi. This shows that in a case where the second metal plate 18 is attached to the housing 11, the second antenna 16 operates as an antenna of high directivity. On the other hand, in a case where the second metal plate 18 is not attached to the housing 11, the second antenna 16 does not exhibit great antenna gain in any direction. This shows that in this case, the second antenna 16 operates as an antenna of low directivity. Then, the second metal plate 18 can be said to be a switching unit that switches the directivity of the antenna from a relatively low state (first state) to a high state (second state). Then, the sensing unit senses switching done by this switching unit.

The embodiment makes it possible, with a simple method of placing the first metal plate 17 and/or the second metal plate 18 in the housing 11, to switch from a wireless communication device having an antenna of low directivity to a wireless communication device having an antenna of high directivity.

In the embodiment, the first sensing unit 19 automatically senses whether the first metal plate 17 has been placed in the housing 11. Similarly, the second sensing unit 20 automatically senses whether the second metal plate 18 has been placed in the housing 11. Therefore, the control unit 25 brings about an effect of making it possible to automatically switch the transmitting output of the wireless communication device 1 by means of the sensing.

In a case where the first protruding portion 17*a* is made of the same material as the first metal plate 17, they bring about an effect of being able to be integrally manufactured. Further, the first protruding portion 17*a* makes it possible to determine the distance between the substrate 13 and the first metal plate 17 and allows the first sensing unit 19 to perform sensing. Accordingly, one first protruding portion 17*a* brings about an effect of being able to serve as two first protruding portions 17*a*. The same applies to the second metal plate 18.

Furthermore, in the embodiment, the first sensing unit 19, such as a photointerrupter, can sense the placement of the first metal plate 17 in the housing 11 without making contact with the first protruding portion 17*a*. Therefore, both the first sensing unit 19 and the first protruding portion 17*a* bring about an effect of being mechanically indestructible. The same applies to the second sensing unit 20.

Figure 6A:
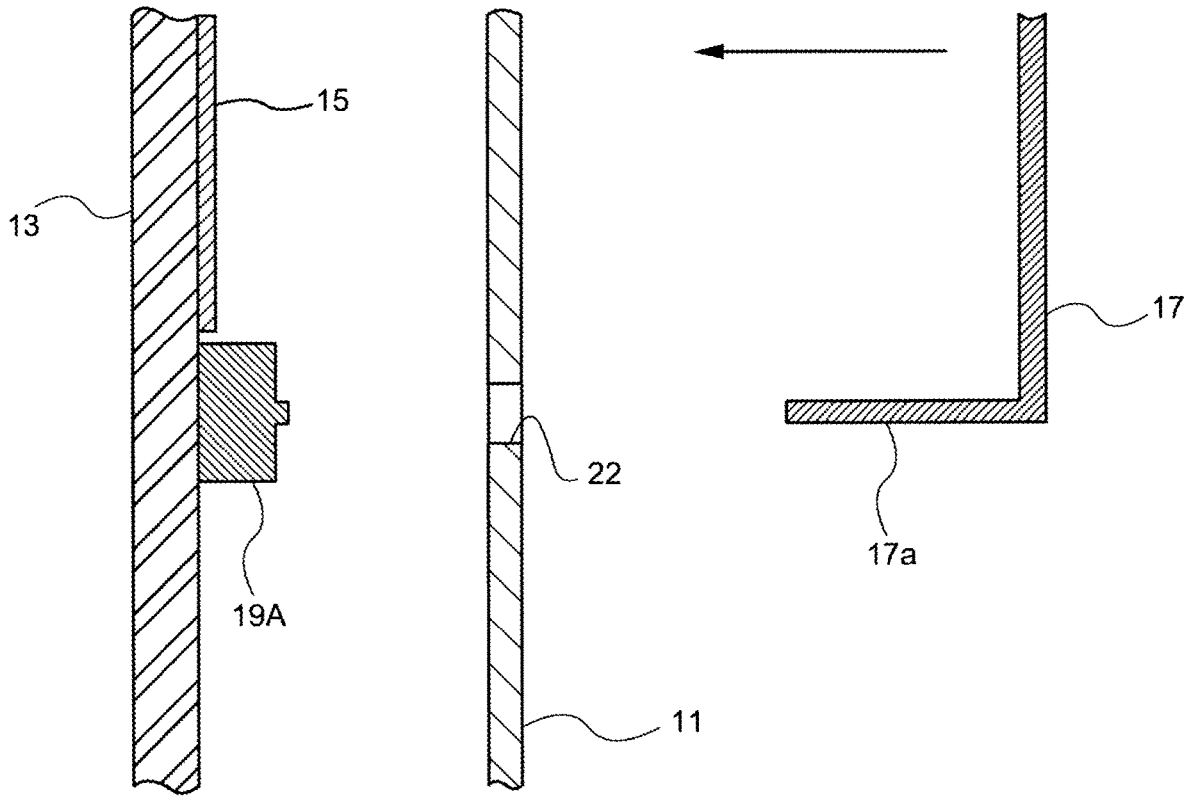
FIG. 6A is an enlarged view (cross-sectional view) of a first sensing unit of the wireless communication device and the area therearound in a case where a first metal plate is not placed in a housing.
Figure 6B:
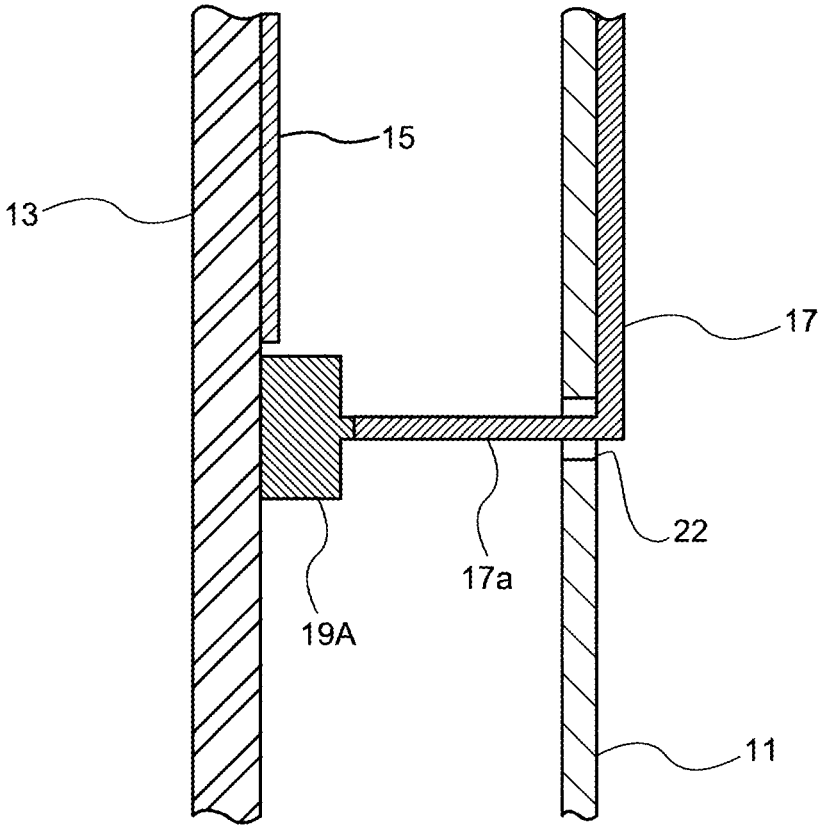
FIG. 6B is an enlarged view (cross-sectional view) of the first sensing unit of the wireless communication device and the area therearound in a case where the first metal plate is placed in the housing.

An embodiment of the present invention is described with reference to FIGS. 6A and 6B. FIG. 6A is an enlarged view (cross-sectional view) of, in a wireless communication device 1A according to an embodiment of the present invention, a first sensing unit 19A of the wireless communication device 1A and the area therearound in a case where the first metal plate 17 is not placed in the housing 11. FIG. 6B is an enlarged view (cross-sectional view) of, in the wireless communication device 1A according to an embodiment of the present invention, the first sensing unit 19A of the wireless communication device 1A and the area therearound in a case where the first metal plate 17 is placed in the housing 11.

In this example, the first sensing unit 19A is a push switch. Therefore, when the push switch is pushed by the first protruding portion 17*a*, the placement of the first metal plate 17 in the housing 11 is sensed. Accordingly, the first sensing unit 19A makes contact with the first protruding portion 17*a*. The switch by which the first metal plate 17 is automatically detected is not limited to the push switch but may be a lever switch or the like.

As shown in FIG. 6A, the first metal plate 17 is moved in the direction of the arrow in the drawing to be placed in the housing 11. At this point of time, as shown in FIG. 6B, when the push switch (first sensing unit 19A) is pushed by the first protruding portion 17*a* of the first metal plate 17, the first sensing unit 19A senses the placement of a case including the first metal plate 17 in the housing 11. The same applies to the second metal plate 18 and a second sensing unit 20A.

The embodiment brings about the same effects as discussed before, except for the effect of the first sensing unit 19 and the first protruding portion 17*a* of being mechanically indestructible.

Further, in the embodiment, the first sensing unit 19A is not a non-contact sensor such as a photointerrupter but a push switch. In general, a push switch is more inexpensive than a photointerrupter. Accordingly, the embodiment makes it possible to configure the first sensing unit 19A more inexpensively.

Figure 7:
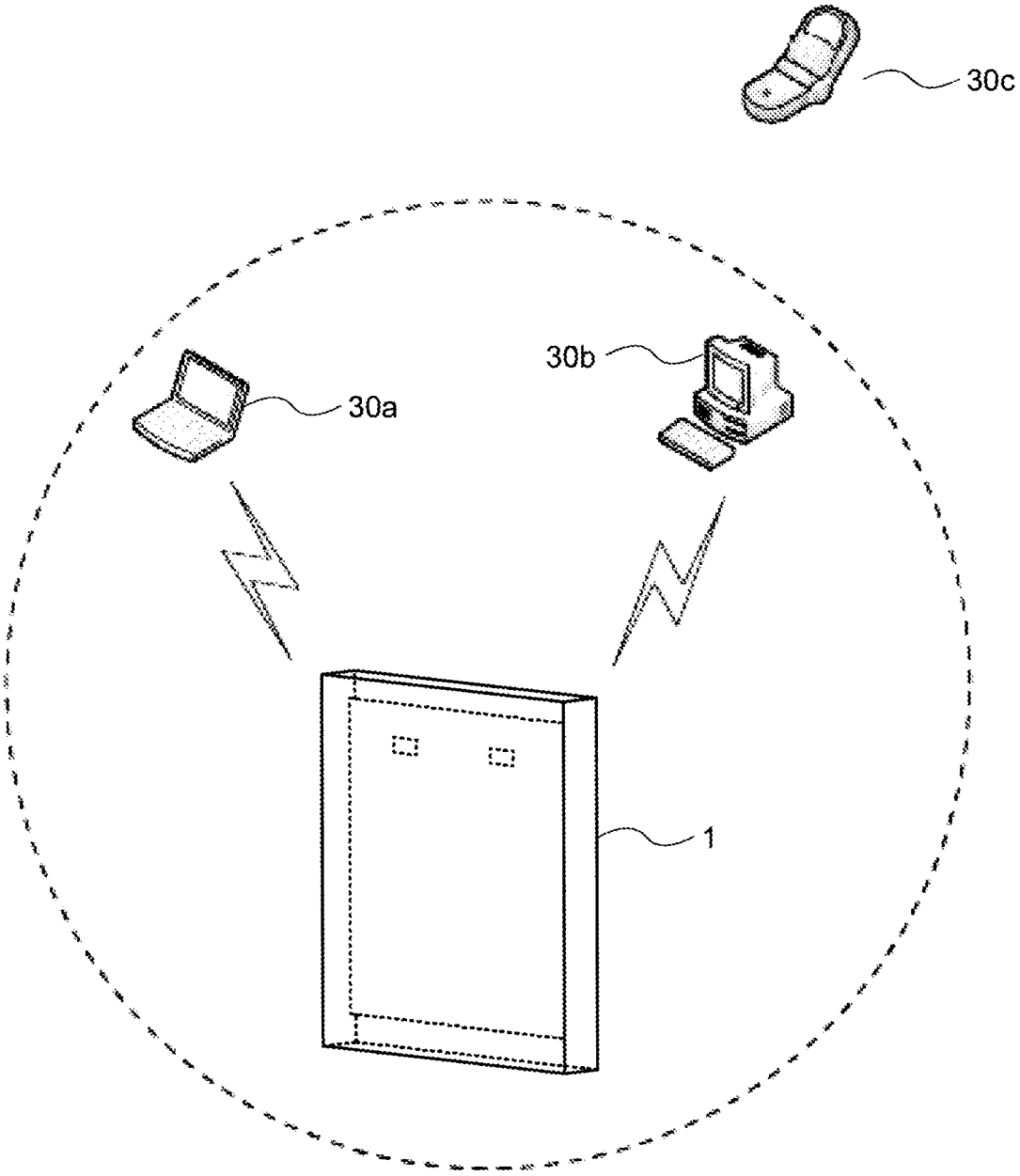
FIG. 7 is a conceptual diagram for explaining a relationship between a wireless communication device and partner terminals.

In an embodiment, in a case where restrictions are imposed on a partner terminal that communicates with the wireless communication device 1, e.g. in a case where a threshold is set for the receiving sensitivity with which the wireless communication device 1 receives signals from the partner terminal, the control unit 25 changes the threshold of receiving sensitivity of the partner terminal to communicate with when the first sensing unit 19 has detected the placement of the first metal plate 17 in the housing 11. For example, in a case where the first metal plate 17 is not placed in the housing 11 of the wireless communication device 1 and communication is performed with a partner terminal receiving signals with a receiving sensitivity of −80 dBm or higher, partner terminals 30*a* and 30*b* are communicating with the wireless communication device 1, as shown in FIG. 7. On the other hand, a partner terminal 30*c* located outside a residence indicated by a dotted line is not communicating with the wireless communication device 1. At this point of time, in a case where the first metal plate 17 is not placed in the housing 11 of the wireless communication device 1, the control unit 25 performs communication with the partner terminals 30*a* and 30*b*, which are receiving signals with a receiving sensitivity of −80 dBm or higher. On the other hand, in a case where the first metal plate 17 has been placed in the housing 11, the threshold may be controlled so that communication is only performed with the partner terminals 30*a* and 30*b*, which are receiving signals with a receiving sensitivity of −77 dBm or higher. This is because in a case where the first metal plate 17 is placed in the housing 11, the receiving level of the wireless communication device 1 can be improved by the first metal plate 17. It should be noted that the receiving sensitivity is measured by an RSSI (received signal strength indication, received signal strength indicator, or received signal strength). An RSSI refers to a circuit or signal for measuring the strength of a signal that a wireless communication apparatus receives. The same applied to the second metal plate 18.

The embodiment brings about such an effect that the threshold for a partner terminal with which the wireless communication device 1 performs communication can be changed by the placement of the first metal plate 17 in the housing 11. As a result, this brings about such an effect that the optimization of the range of partner terminals with which to perform communication can be maintained without covering an unnecessarily distant partner terminal.

In an embodiment, the control unit 25 may define a modulation scheme and/or a wireless LAN standard when the first sensing unit 19 has sensed the placement of the first metal plate 17 in the housing 11. Note here that the placement of the first metal plate 17 in the housing 11 provides a better transmitting and receiving environment for the wireless communication device 1. Therefore, for example, in a case where a 64 QAM modulation scheme is used when the first metal plate 17 is not placed in the housing 11, the modulation scheme may be changed to 256 QAM when the first sensing unit 19 has sensed the placement of the first metal plate 17 in the housing 11. Similarly, for example, when the first sensing unit 19 has sensed the placement of the first metal plate 17 in the housing 11, IEEE 802.11ac communication is not performed but another type of communication such as IEEE 802.11g may be performed. The same applies to the second metal plate 18.

The embodiment brings about an effect of making it possible to change modulate schemes depending on the presence or absence of the placement of the first metal plate 17 in the housing 11.

The placement of the first metal plate 17 in the housing 11 provides a better transmitting and receiving environment for the wireless communication device 1. Accordingly, when the first sensing unit 19 has sensed the placement of the first metal plate 17 in the housing 11, the output unit 24 outputs a result of sensing. Then, the control unit 25 controls the communication unit 26 so that the communication unit 26 transmits, to a partner terminal, a signal representing the sensing of the placement of the first metal plate 17 in the housing 11. Furthermore, the signal is transmitted from the first antenna 15 to the partner terminal. Upon receiving the signal, the partner terminal can achieve low power consumption for example by reducing the gain of an intermediate frequency amplifier.

In an embodiment, depending on whether the first metal plate 17 is placed in the housing 11, the wireless communication device 1 transmits, to a partner terminal, a signal indicating whether the first metal plate 17 is placed in the housing 11. As a result, this brings about an effect of allows the partner terminal to adaptively achieve lower power consumption.

The foregoing embodiments have described on the premise that the wireless communication device 1 or the wireless communication device 1A communicates with the partner terminals 30*a* and 30*b* wirelessly. However, the wireless communication device 1 or 1A may also communicate with the partner terminals 30*a* and 30*b* by cable. That is, the wireless communication device 1 or 1A may also use a cable communication function in addition to a wireless communication function. Further, the wireless communication device 1 or 1A may not only communicate with the terminals 30*a* and 30*b* but also communicate with another wireless communication device. For example, wireless access points may communicate with each other using a WDS (wireless distribution system) function.

It should be noted that the present invention is not limited to the embodiments described above but may be changed as appropriate without departing from the scope of the present invention.

What is claimed is:

1. A wireless communication device comprising:

a housing;

an antenna placed within the housing;

a metal plate detachably placed on the housing, the metal plate being higher in electric conductivity than the housing and having a surface facing the antenna when the metal plate is placed on the housing;

a sensor configured to sense whether the metal plate has been placed; and a controller configured to receive a result of sensing detected by the sensor, wherein the metal plate has a length greater than $\lambda/2$ and less than $4\lambda/5$ with respect to a frequency that the antenna uses.

2. The wireless communication device according to claim 1, further comprising a substrate placed inside the housing, wherein the antenna is an antenna placed on the substrate.

3. The wireless communication device according to claim 1, wherein the metal plate is a director.

4. The wireless communication device according to claim 1, wherein the sensor senses whether the metal plate has been placed without making contact with a portion of the metal plate.

5. The wireless communication device according to claim 1, wherein the controller is configured to control an operation mode on the basis of the result of sensing detected by the sensor.

6. The wireless communication device according to claim 5, wherein the controller is configured to reduce an output of the antenna.

7. The wireless communication device according to claim 1, wherein the antenna transmits, to a receiver, the result of sensing detected by the sensor.

8. The wireless communication device according to claim 1, wherein the antenna includes a first antenna oscillating at a first frequency and a second antenna oscillating at a second frequency higher than the first frequency, and the metal plate includes a first metal plate facing the first antenna when placed in the housing and a second metal plate shorter in length than the first metal plate and facing the second antenna when placed in the housing.

9. The wireless communication device according to claim 1, further comprising a signal processor configured to transmit and receive information to and from a wireless terminal via the antenna.

10. The wireless communication device according to claim 1, wherein the wireless communication device is a wireless LAN router or a wireless access point.

11. A wireless communication device comprising:

a housing;

an antenna placed within the housing;

a metal plate detachably placed on the housing, the metal plate having a surface facing the antenna when the metal plate is placed on the housing and making directivity higher in a direction opposite to the antenna when placed on the housing than when not placed on the housing;

a sensor configured to sense whether the metal plate has been placed; and a controller configured to receive a result of sensing detected by the sensor, wherein the metal plate has a length greater than $\lambda/2$ and less than $4\lambda/5$ with respect to a frequency that the antenna uses.

12. The wireless communication device according to claim 11, further comprising a substrate placed inside the housing, wherein the antenna is an antenna placed on the substrate.

13. The wireless communication device according to claim 11, wherein the metal plate is a director.

14. The wireless communication device according to claim 11, wherein the metal plate has a portion inserted in the hosing.

15. The wireless communication device according to claim 11, wherein a distance between the antenna and the metal plate is greater than $\lambda/20$ and less than $\lambda/2$ with respect to a frequency that the antenna uses.

16. The wireless communication device according to claim 11, wherein the sensor senses whether the metal plate has been placed without making contact with a portion of the metal plate.

17. A wireless communication device comprising:

a housing;

an antenna placed within the housing;

a metal plate detachably placed on the housing, the metal plate being higher in electric conductivity than the housing and having a surface facing the antenna when the metal plate is placed on the housing;

a sensor configured to sense whether the metal plate has been placed; and a controller configured to receive a result of sensing detected by the sensor, wherein a distance between the antenna and the metal plate is greater than $\lambda/20$ and less than $\lambda/2$ with respect to a frequency that the antenna uses.

18. The wireless communication device according to claim 17, further comprising a substrate placed inside the housing, wherein the antenna is an antenna placed on the substrate.

19. The wireless communication device according to claim 17, wherein the metal plate is a director.

20. The wireless communication device according to claim 17, wherein the sensor senses whether the metal plate has been placed without making contact with a portion of the metal plate.

* * * * *